United States Patent [19]

Guertin et al.

[11] 4,125,139

[45] Nov. 14, 1978

[54] AUTOMATIC SHUT-OFF NOZZLE HAVING AN ARRANGEMENT FOR SENSING THE PRESENCE OF LIQUID IN VAPOR RETURN MEANS OF THE NOZZLE

[75] Inventors: Robert W. Guertin, Cincinnati; Chester W. Wood, Milford, both of Ohio

[73] Assignee: Dover Corporation, New York, N.Y.

[21] Appl. No.: 803,048

[22] Filed: Jun. 3, 1977

[51] Int. Cl.[2] ..... B65B 57/14

[52] U.S. Cl. ..... 141/206

[58] Field of Search ..... 141/1, 46, 52, 59, 93, 141/97, 128, 198, 206, 207–229, 290, 291, 301, 302, 392

[56] References Cited

U.S. PATENT DOCUMENTS

| | | | |
|---|---|---|---|
| 3,946,773 | 3/1976 | Hansel | 141/206 |
| 3,996,979 | 12/1976 | Barr et al. | 141/302 |

*Primary Examiner*—Houston S. Bell

*Attorney, Agent, or Firm*—John G. Schenk

[57] ABSTRACT

Liquid flow through an automatic shut-off nozzle is automatically stopped when liquid is present at a predetermined location in the vapor return means. The automatic shut-off nozzle also stops flow in response to the tank being filled to a predetermined level with liquid or the pressure in the tank exceeding a predetermined pressure.

14 Claims, 15 Drawing Figures

AUTOMATIC SHUT-OFF NOZZLE HAVING AN ARRANGEMENT FOR SENSING THE PRESENCE OF LIQUID IN VAPOR RETURN MEANS OF THE NOZZLE

When filling a vehicle tank with gasoline through a dispensing nozzle, vapors from the gasoline within the tank can be prevented from escaping through the fill pipe opening in which the spout of the nozzle is inserted by sealing the fill pipe opening. Thus, the escape of the gasoline vapors into the atmosphere is prevented so that pollution of the atmosphere is decreased. The vapors within the tank can be recovered through vapor recovery equipment utilized in conjunction with the nozzle.

However, the level of the gasoline within the vehicle tank being filled cannot be viewed because of the sealing of the fill pipe opening. Therefore, it is necessary for there to be automatic shut off of the supply of gasoline with a nozzle having a vapor recovery arrangement.

The automatic shut-off mechanism, which automatically stops the supply of gasoline to the vehicle tank, depends upon the level of the liquid in the tank reaching a predetermined level at which it blocks a vacuum passage opening in the nozzle spout to cause activation of release means to move the main poppet valve, which is controlling liquid flow from the inlet of the nozzle body through the body, to its closed position. However, because of the angles of the fill pipes of certain vehicles, the spout may be so disposed within the fill pipe that the vacuum passage opening in the nozzle spout cannot be blocked by the level of the gasoline in the vehicle tank prior to the gasoline flowing through vapor return means in the nozzle body.

Because of the vapor return seal sealing the fill pipe opening, the attendant cannot see the pitch of the nozzle spout within the fill pipe. Thus, the attendant cannot position the nozzle spout within the fill pipe so that the vacuum passage opening in the nozzle spout would be located so as to be blocked by the level of the gasoline in the tank prior to the gasoline in the tank escaping therefrom through the vapor return means in the nozzle body.

Accordingly, if the vacuum passage opening in the nozzle spout is not blocked by the level of the gasoline in the tank prior to the gasoline being able to flow through the vapor return means in the nozzle body, gasoline would be pumped through the fill pipe to the tank and then returned to the vapor recovery equipment through the vapor return means in the nozzle body. As a result, the customer would pay for gasoline not received since the pumping of gasoline is utilized to determine the quantity supplied to the customer.

The present invention satisfactorily solves the foregoing problems through providing an arrangement in which the presence of the liquid at a predetermined location in the vapor return means of the nozzle body is sensed. When the presence of the liquid is sensed at the predetermined location, the flow of gasoline through the nozzle is automatically stopped. Thus, flow of the gasoline is stopped even when the vacuum passage opening in the nozzle spout cannot be blocked by the level of the gasoline in the tank because of the angle of the fill pipe.

With the present invention, the automatic shut-off nozzle is still responsive to the blocking of the vacuum passage opening in the nozzle spout when the liquid in the tank reaches the predetermined level. Thus, the present invention enables the automatic shut-off nozzle to continue to be effective when the flow rate is high enough to generate sufficient foam to block the spout opening.

With the present invention, the automatic shut-off nozzle also is still responsive to the pressure in the tank exceeding a predetermined pressure. Accordingly, the automatic shut-off nozzle of the present invention is still responsive to the two conditions within the tank in which it is desired to stop liquid flow to the tank being filled.

An object of this invention is to provide an automatic shut-off nozzle having an arrangement capable of stopping flow automatically whenever liquid is at a predetermined position within the vapor return means of the nozzle.

Another object of this invention is to provide an automatic shut-off nozzle that automatically stops flow in response to any of the following: the liquid level in the tank being filled reaching a predetermined level, the pressure in the tank exceeding a predetermined pressure, or liquid being present at a predetermined position within the vapor return means of the nozzle.

Other objects, uses, and advantages of this invention are apparent upon a reading of this description which proceeds with reference to the drawings forming part thereof and wherein.

Figure 1:
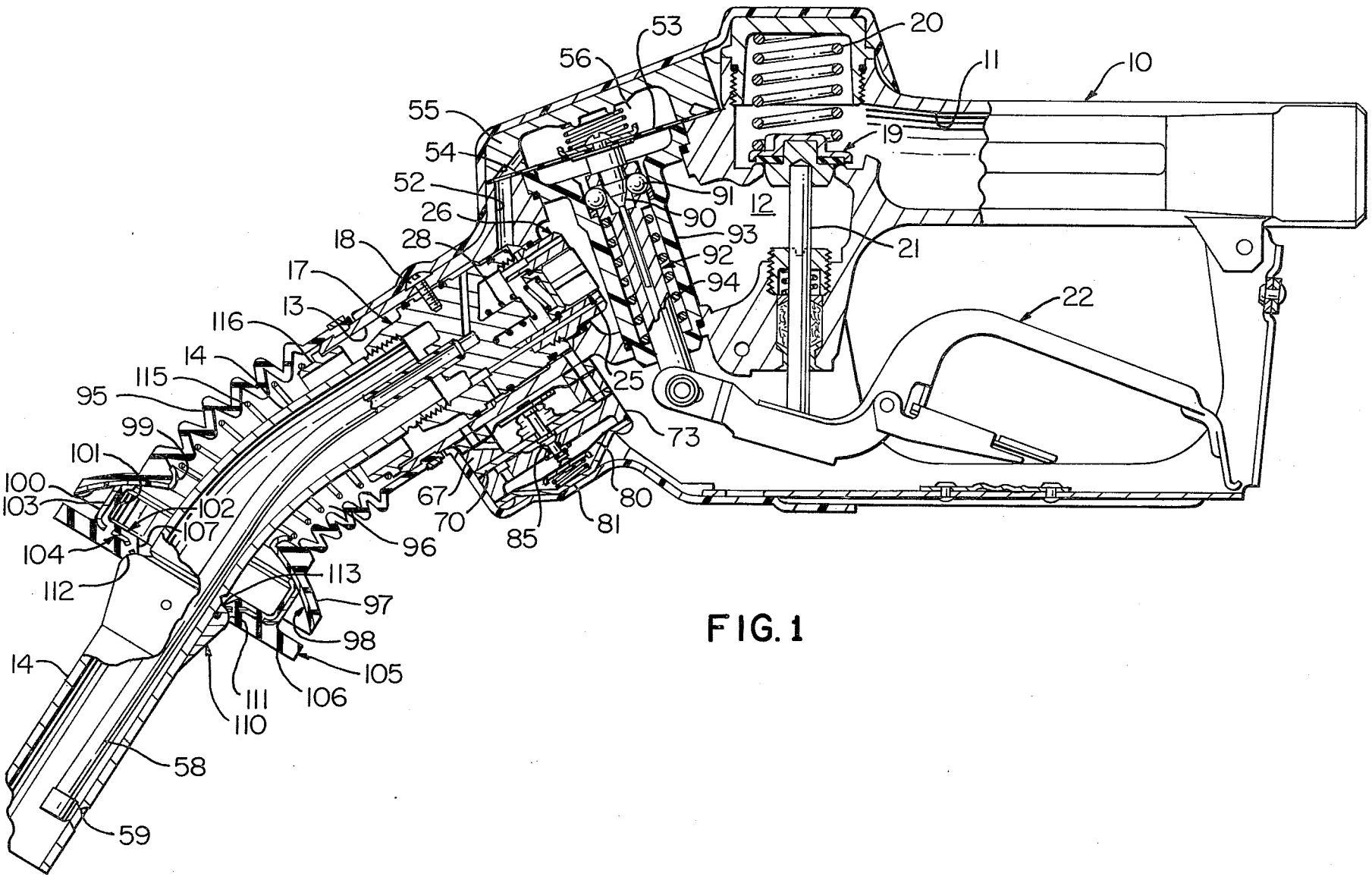
FIG. 1 is a sectional view, partly in elevation, of a nozzle having one form of the sensing arrangement of the present invention.

Referring to the drawings and particularly FIG. 1, there is shown a nozzle body 10 having an inlet 11 to which a hose is connected to supply liquid such as gasoline, for example, to a chamber 12 within the interior of the body 10. The body 10 has an outlet 13 with which a spout 14 communicates to receive liquid from the chamber 12 within the interior of the body 10.

The spout 14, which is adapted to be inserted within an opening 15 (see FIG. 3) in a fill pipe 16 of a vehicle tank such as an automobile fuel tank, for example, has an end threaded in a spout adapter 17. The spout adapter 17 is connected to the outlet 13 of the body 10 by a screw 18.

The body 10 has a first or main poppet valve 19 supported therein for control of the flow of liquid from the inlet 11 to the chamber 12 within the interior of the body 10 and from the chamber 12 to the spout 14. A spring 20 continuously urges the poppet valve 19 to its closed position in which flow from the inlet 11 to the chamber 12 and the spout 14 is stopped or prevented.

A stem 21 is connected to the poppet valve 19 and has its lower portion extending exteriorly of the body 10. The valve stem 21, which is slidably disposed within the body 10, is moved by a manually operated lever or handle 22. The stem 21 passes through the body 10 in the same manner as described in U.S. Pat. No. 3,811,486 to Wood.

A by-pass or bleeder poppet valve 25 is slidably mounted within a passage 24 (see FIG. 1A) in a seat ring 26. The seat ring 26 is secured to the spout adapter 17 by being threadedly connected thereto. A sealing ring 27 is disposed between the body 10 and the seat ring 26 to prevent leakage therebetween.

A spring 28, which has one end engaging a portion of the spout adapter 17 and its other end engaging a flat surface 29 of a cup-shaped element 30 of the by-pass valve 25, urges the by-pass valve 25 to its closed position in which an O-ring 31, which is carried in a groove 32 in the cup-shaped element 30 of the by-pass valve 25, engages an angled surface 33 of the seat ring 26 to allow the valve 25 to close the passage 24. Thus, only the pressure of liquid going from the inlet 11 and past the main poppet valve 19 can overcome the spring 28 and move the by-pass valve 25 to an open position in which the sealing ring 31 no longer engages the surface 33 of the seat ring 26.

The cup-shaped element 30 of the by-pass valve 25 has four legs 35 (three shown) extending from a flat surface 39, which is parallel to the surface 29, thereof. The legs 35, which are equally angularly spaced from each other, cooperate with the wall of the passage 24 in the seat ring 26 to guide the sliding movement of the by-pass valve 25 in the passage 24.

The seat ring 26 has a first passage 40 having one end communicating with the chamber 12 within the interior of the body 10 and its other end communicating with one end of a second passage 41 in the seat ring 26. The other end of the second passage 41 communicates with the downstream sides of the seat ring 26 and the by-pass valve 25.

The first passage 40 has a smaller diameter than the second passage 41 to form a shoulder 42 at the junction of the first passage 40 and the second passage 41. The seat ring 26 has a third passage 43, which has its axis substantially perpendicular to the axis of the passages 40 and 41 and has a slightly smaller diameter than the first passage 40, communicating with the second passage 41 and an annular chamber 51, which is formed between the body 10, the spout adapter 17, and the seat ring 26.

As the liquid flows through the first passage 40 and the second passage 41, a venturi effect is created in the third passage 43. This is because the increase in the cross sectional area of the second passage 41 compared with the cross sectional area of the first passage 40 produces an expansion of the liquid to reduce its velocity whereby air is drawn from the third passage 43 into the second passage 41. The third passage 43 communicates through the chamber 51, a passage 52 in the body 10, an opening in a diaphragm 53 (see FIG. 1), and a passage 54 in a cap 55 to a chamber 56, which is formed between the diaphragm 53 and the cap 55.

The chamber 51 also communicates with a vacuum tube 58, which is connected with an opening 59 (see FIG. 1) in the spout 14 adjacent the discharge or free end of the spout 14. The tube 58 communicates through a passage 60 (see FIG. 1A) in the spout adapter 17 with an annular chamber 61, which is formed between sealing rings 57 (see FIG. 1A) and 57', the spout adapter 17, and the body 10.

The annular chamber 61 communicates through a passage 62 (see FIG. 2) in the body 10, an opening in a seal 63, which is disposed between the body 10 and a body 64, a passage 65 in the body 64, an opening in a diaphragm 66, which is disposed between the body 64 and a body 67, a passage 68 in the body 67, an opening in a seal 69, which is disposed between the body 67 and a body 70, a passage 71 in the body 70, an opening in a seal 72, which is disposed between the body 70 and a housing 73, to a horseshoe-shaped passage 74 in the housing 73. The bodies 64, 67, and 70 and the housing 73 are secured to the body 10 by screws 75. The horseshoe-shaped passage 74 in the housing 73 has a shape like that shown in FIG. 7.

The horseshoe-shaped passage 74 in the housing 73 communicates through a passage 77 (see FIG. 1A) in a divider 78 of the housing 73 with a chamber 79, which is formed between the divider 78 and a diaphragm 80. A retainer 81 holds the diaphragm 80 on the housing 73. The retainer 81 is secured by the screws 75 to the body 10.

The chamber 79 communicates through a passage 83 in the divider 78 of the housing 73 with a chamber 84, which is formed within the housing 73 between the divider 78 and the body 70. The passage 83 is controlled by a poppet valve 85, which is responsive to the diaphragm 80.

The chamber 84 communicates with the annular chamber 51 through a passage 86 in the body 70, an opening in the seal 69, a passage 87 in the body 67, an opening in the diaphragm 66, a passage 88 in the body 64, an opening in the seal 63, and a passage 89 in the body 10.

Accordingly, as long as the poppet valve 85 is open and the opening 59 is not closed due to the liquid within the tank reaching a predetermined level that indicates that the tank is filled, the venturi effect created by the flow of the liquid through the passages 40 and 41 in the seat ring 26 draws air through the tube 58 to create a partial vacuum within the chamber 56. However, as soon as the opening 59 is blocked or the valve 85 is closed, the chamber 56 (see FIG. 1) has its pressure reduced due to the air therein being withdrawn therefrom because of the venturi effect in the third passage 43 (see FIG. 1A) due to the liquid flowing through the passages 40 and 41 whereby the diaphragm 53 (see FIG. 1) moves upwardly since the partial vacuum in the chamber 56 is increased.

The diaphragm 53 has a latch retaining pin 90 secured thereto for movement therewith and disposed between three balls 91 (two shown), which are positioned within passages in a latch plunger 92. When the latch retaining pin 90 is in the position shown in FIG. 1, the balls 91 prevent downward movement of the plunger 92, which is slidably mounted within an insert 93. The insert 93, which is preferably formed of a plastic, is supported in the body 10.

When the diaphragm 53 is moved upwardly due to the increase in the partial vacuum in the chamber 56, the latch retaining pin 90 is moved upwardly therewith. The upward movement of the retaining pin 90 disposes a tapered portion of the retaining pin 90 between the balls 91 whereby the balls 91 may move inwardly to allow the plunger 92 to be moved downwardly against the force of its spring 94. The correlation between the tapered portion of the pin 90 and the latch plunger 92 is more specifically shown in U.S. Pat. No. 2,582,195 to Duerr.

The lower end of the plunger 92 is connected to the handle 22 as more particularly shown and described in U.S. Pat. No. 3,817,285 to Wilder et al. Thus, when the diaphragm 53 moves upwardly to pull the latch retaining pin 90 and release the latch plunger 92 from the balls 91, the force of the spring 20 closes the main poppet valve 19 as more particularly shown and described in the aforesaid Wilder et al. patent.

The body 10 has a bellows 95, which is preferably formed of a gasoline resistant synthetic rubber, secured thereto and extending from the outlet 13 of the body 10 towards the free or discharge end of the spout 14. The bellows 95 is disposed in spaced relation to the spout 14 to form an annular passage 96 therebetween.

The end of the bellows 95 remote from the outlet 13 of the body 10 has a member 97, which is preferably formed integral therewith. The member 97 has a member 98, which is a plastic such as acetal plastic, for example, connected by the member 98 having its curved portion snapped into the bellows 95 and retained therein by the resilience of the bellows 95. The member 98 has an opening 99 formed in the center thereof to enable the member 98 to slide along the spout 14.

The member 98 has its surface 100 formed as a sector of a sphere so that a cylindrical extension 101 of a member 102, which is preferably formed of the same material as the member 97, engages the surface 100 irrespective of the position of the member 102 in the spout 14. The member 102 has its cylindrical extension 101 supported by a cylindrical extension 103 of a plate 104, which is preferably formed of a suitable metal such as stainless steel, for example. The member 102 is molded integral with the plate 104 so that the cylindrical extension 101 of the member 102 is secured to the cylindrical extension 103 of the plate 104.

The plate 104 has openings formed therein so that the member 102 has a disc 105 disposed on the opposite side of the plate 104 from the cylindrical extension 101. Thus, the member 102, the plate 104, and the disc 105 form a sealing member with the disc 105 having its flat surface 106 functioning as a sealing surface. The member 102, the plate 104, and the disc 105 have an opening 107 to enable them to be both slidably and rotatably mounted on the spout 14.

A retainer 110, which functions as a stop, is fixed to the spout 14 between the disc 105 and the discharge or free end of the spout 14 by suitable means such as a set screw, for example. The retainer 110 has a curved surface 111, preferably formed as a portion of a sphere as more particularly shown and described in U.S. Pat. No. 4,003,415 to Donald A. Lasater. The disc 105 has an inner curved surface 112, preferably formed as a sphere as more particularly shown and described in the aforesaid Lasater patent, engaging the curved surface 111 of the retainer 110 to form a seal therewith when the spout 14 is not inserted within the opening 15 of the fill pipe 16.

The retainer 110 has an inner flat surface 113, which is disposed inside of the surface 111. The surface 113 functions to lock the spout 14 within the fill pipe 16 through cooperation with a lip 114 of the fill pipe 16 as shown in FIG. 3.

Accordingly, when the spout 14 is not inserted in the opening 15 of the fill pipe 16, the annular passage 96, which is connected to the vapor recovery equipment, is not connected to the atmosphere but is sealed through the cylindrical extension 101 of the member 102 engaging the surface 100 of the member 98 and the disc 105 having its inner curved surface 112 engage the outer curved surface 111 of the retainer 110. When the spout 14 is inserted into the opening 15 (see FIG. 3) of the fill pipe 16, the outer flat surface 106 of the disc 105 abuts the end of the fill pipe 16 so as to not follow the movement of the spout 14 and the retainer 110 into the fill pipe 16. This results in the bellows 95, which continuously urges the member 98 toward the free end of the spout 14 so that the spherical surface 100 of the member 98 is always in engagement with the cylindrical extension 101 of the member 102 and the cylindrical extension 103 of the plate 104, being slightly compressed.

Figure 3:
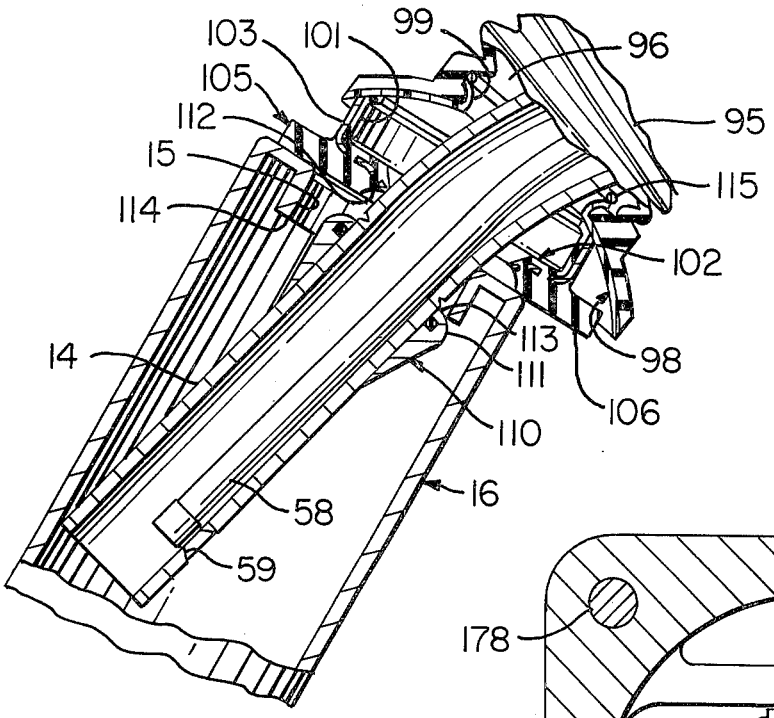
FIG. 3 is a fragmentary longitudinal sectional view of a portion of the nozzle of FIG. 1 and showing the spout of the nozzle of FIG. 1 in the fill pipe of a vehicle tank.

Accordingly, when the spout 14 is in the position of FIG. 3, vapor within the tank can flow through the opening 15 in the fill pipe 16 and the opening 99 into the annular passage 96 from which it flows to the vapor recovery equipment. Thus, the movement of the spout 14 into the fill pipe opening 15 results in the seal between the disc 105 and the retainer 110 being broken whereby the vapor can be removed from the tank being filled.

It should be understood that a spring 115 continuously urges the disc 105 into engagement with the retainer 110. The upper end of the spring 115 engages an annular sleeve 116, which has its movement limited by engaging the outlet end of the body 10. The annular sleeve 116 enables the vapors to pass between the annular sleeve 116 and the spout 14.

As previously mentioned, the poppet valve 85 is responsive to the diaphragm 80, which has one end of a spring 117 (see FIG. 1A) acting thereagainst. The other end of the spring 117 acts against the retainer 81. A spring 118 has one end disposed in a groove in the poppet valve 85 so that the spring 118 urges the poppet valve 85 to its closed position, but the force of the spring 118 is not as strong as the force of the spring 117, which urges the poppet valve 85 to its normally open position through a rivet in the diaphragm 80 being held against the end of the poppet valve 85 by the spring 117.

However, if the vapor pressure in the tank, which is being filled and has the fill pipe opening 15 (see FIG. 3) sealed by the flat surface 106 of the disc 105 engaging the end of the fill pipe 16, increases beyond a predetermined pressure, the diaphragm 80 (see FIG. 1A) is moved against the force of the spring 117 to permit the poppet valve 85 to move to its closed position in response to the action of the spring 118. When this occurs, air from the opening 59 (see FIG. 1) to the third passage 43 (see FIG. 1A) in the seat ring 26 is stopped so that the partial vacuum in the chamber 56 (see FIG. 1) is increased because of the venturi effect created by the liquid flowing through the passages 40 (see FIG. 1A) and 41 to cause automatic closing of the main poppet valve 19 (see FIG. 1). This response of the diaphragm 80 to the vapor pressure in the sealed tank is more particularly shown and described in the aforesaid Wood patent.

The seat ring 26 has a fourth passage 120 (see FIG. 1A) having one end communicating with the chamber 12 (see FIG. 1) within the interior of the body 10 and its other end communicating with one end of a first passage 121 (see FIG. 1A) in the spout adapter 17. The passages 120 and 121 are the same diameter so that they comprise a first passage of a venturi. The other end of the first passage 121 in the spout adapter 17 communicates with one end of a second passage 122 in the spout adapter 17. The other end of the second passage 122 communicates with the downstream side of the spout adapter 17. The second passage 122 has a larger diameter than the first passage 121 to form a shoulder 123 at the junction thereof.

The spout adapter 17 has a third passage 124, which has its axis substantially perpendicular to the axis of the passages 120–122 and has a slightly smaller diameter than the passages 120 and 121, communicating with the second passage 122 and an annular chamber 125, which is formed between the body 10 and the spout adapter 17. The chamber 125 is disposed between the sealing ring 57 and a sealing ring 126. The sealing ring 126 which is disposed between the spout adapter 17 and the body 10, prevents air from entering the annular chamber 125.

As the liquid flows through the fourth passage 120 in the seat ring 26, the first passage 121 in the spout adapter 17, and the second passage 122 in the spout adapter 17, a venturi effect is created in the third passage 124. This is because the increase in the cross sectional area of the second passage 122 compared with the cross sectional area of each of the passages 120 and 121 produces an expansion of the liquid to reduce its velocity whereby air is drawn from the third passage 124 into the second passage 122.

The third passage 124 communicates through the annular chamber 125, a passage 127 (see FIG. 2) in the nozzle body 10, an opening in the seal 63, a passage 128 in the body 64, an opening in the diaphragm 66, and a passage 129 in the body 67 to a chamber 130, which is formed between the diaphragm 66, the inner surface of the body 67, the body 70, and a bellows 131. The chamber 130 communicates through a passage 132 (see FIG. 1A) in the body 67, an opening in the diaphragm 66, a passage 133 in the body 64, an opening in the seal 63, and a passage 134 in the body 10 to the vapor return passage 96. Thus, the air for the third passage 124 in the spout adapter 17 is drawn from the tank being filled through the annular passage 96.

A chamber 136 is formed on the opposite side of the diaphragm 66 from the chamber 130. The chamber 136 is formed between the diaphragm 66, the body 10 and the inner surface of the annular body 64. The chamber 136 communicates through a passage 137 (see FIG. 2) in the body 10 with the atmosphere. Thus, there is a pressure differential created across the diaphragm 66.

As long as the passage 134 (see FIG. 1A) is not blocked by liquid within the annular passage 96 due to gasoline flowing from the tank being filled through the annular passage 96 to the vapor recovery equipment, the venturi effect created by the flow of liquid through the passages 120–122 draws air to create a partial vacuum within the chamber 130. However, as soon as the passage 134 is blocked by liquid in the annular passage 96, which is communicating with the vapor recovery equipment through a vapor return passage (not shown) in the body 10 as more particularly shown and described in the copending patent application of Jack A. McMath for "Automatic Shut-Off Nozzle Having Vapor Return Seal," Ser. No. 684,441, filed May. 7, 1976, and assigned to the same assignee as the assignee of this application, the chamber 130 has its pressure reduced due to the air therein being withdrawn therefrom because of the venturi effect in the third passage 124 due to the liquid flowing through the passages 120–122 whereby the atmospheric pressure in the chamber 136 moves the diaphragm 66 outwardly since the partial vacuum in the chamber 130 is increased.

The diaphragm 66 has a stem 138 of the poppet valve 85 secured thereto for movement therewith. The stem 138 is enclosed within the bellows 131 so that there is no communication between the chambers 84 and 130.

When the diaphragm 66 is moved outwardly because of the increase in the partial vacuum in the chamber 130, the poppet valve 85 blocks the passage 83. As a result, the diaphragm 53 (see FIG. 1) moves upwardly in the same manner as it does whenever the opening 59 is blocked or the valve 85 is closed due to the pressure in the tank increasing. As a result, the main poppet valve 19 is closed in the manner previously described when the opening 59 is blocked or the poppet valve 85 is closed.

Figure 1A:
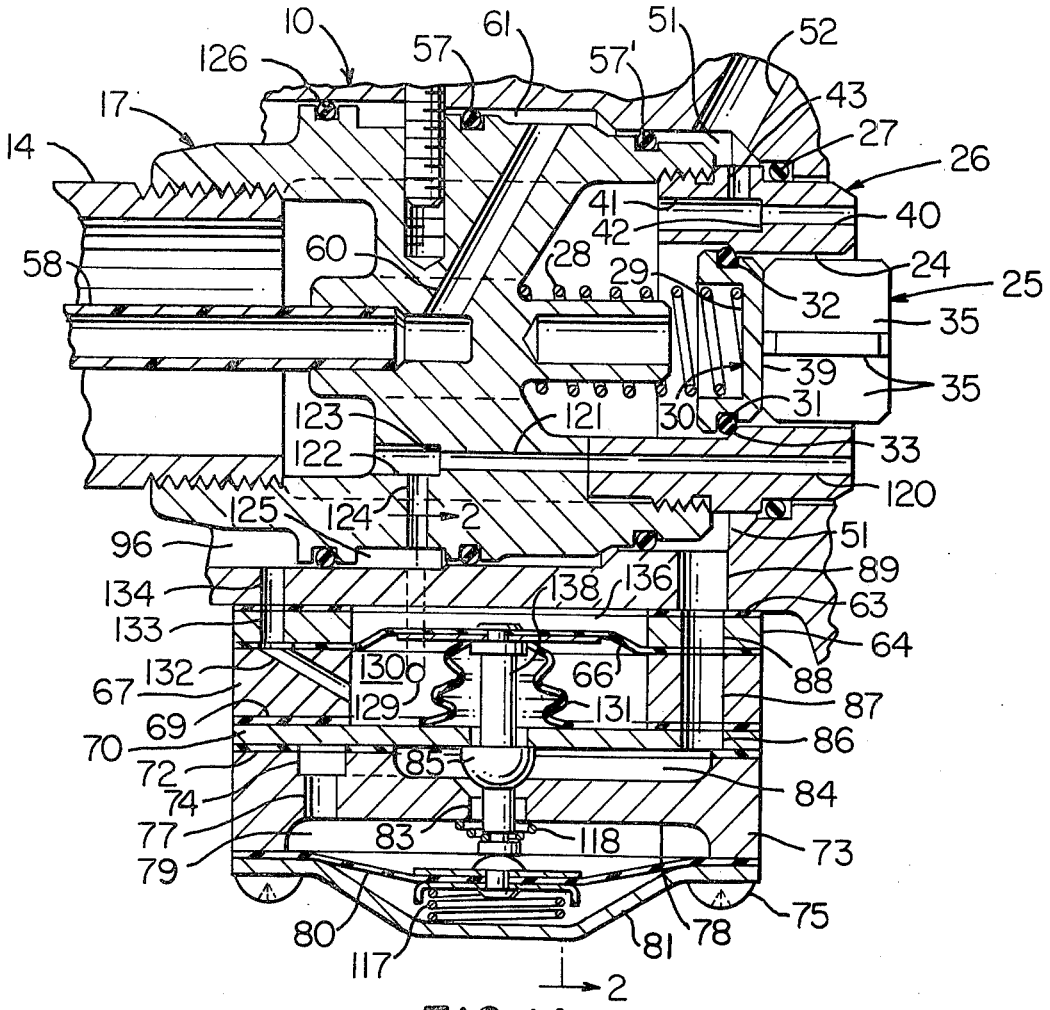
FIG. 1A is an enlarged fragmentary sectional view of a part of FIG. 1.
Figure 2:
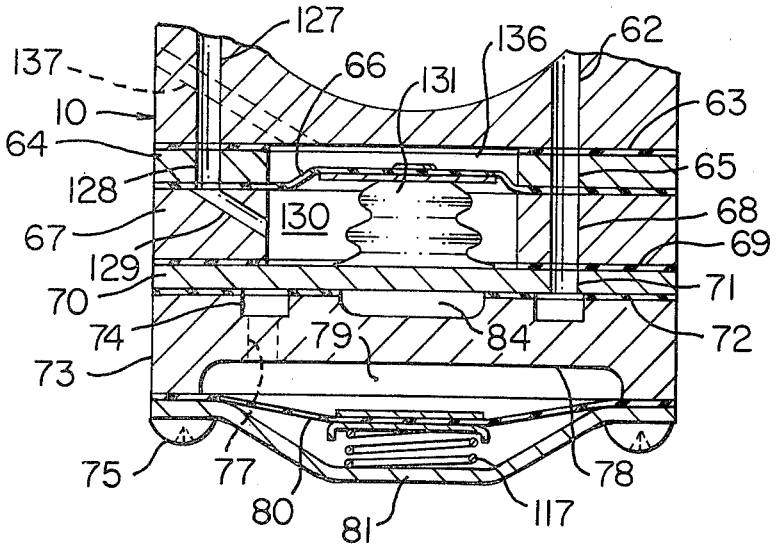
FIG. 2 is a fragmentary sectional view of a portion of the nozzle of FIG. 1 taken along line 2—2 of FIG. 1A but with the spout adapter removed.

Considering the operation of the embodiment of FIGS. 1, 1A, and 2 of the present invention, the poppet valve 85 is normally in an open position as shown in FIGS. 1 and 1A. With the valve 85 in this position and the spout 14 disposed in the fill pipe opening 15 (see FIG. 3), opening of the main poppet valve 19 (see FIG. 1) by the handle 22 causes liquid to flow from the inlet 11 to the chamber 12. The force of the spring 28 is set so that it requires a pressure differential of 2½ p.s.i. for the by-pass valve 25 to be moved to an open position to allow flow through the passage 24 (see FIG. 1A) in the seat ring 26. Liquid flows from the passage 24 in the seat ring 26 through the spout adapter 17 into the spout 14 from which it flows to the tank being filled.

Liquid also flows through the passages 40 and 41 in the seat ring 26 to produce the venturi effect whereby air is drawn into the passage 43 from the annular chamber 51. The chamber 51 draws air from the tank being filled through the opening 59 (see FIG. 1) as long as the opening 59 is not blocked and the poppet valve 85 is open. When the opening 59 is blocked by the level of the liquid in the tank being filled reaching a level at which it blocks the opening 59, air can no longer be drawn through the opening 59 so that air is withdrawn from the chamber 56. This removal of air from the chamber 56 increases the partial vacuum in the chamber 56 and causes the main poppet valve 19 to be automatically closed because of the diaphragm 53 moving upwardly to cause the latch retaining pin 90 to move upwardly therewith and enable the spring 20 to close the main poppet valve 19 as more particularly shown and described in the aforesaid Wilder et al patent.

Liquid also flows through the passages 120–122 (see FIG. 1A) to produce a venturi effect whereby air is drawn into the third passage 124 in the spout adapter 17 from the annular chamber 125. The chamber 125 draws air from the tank being filled through the annular passage 96, the passages 134, 133, and 132, the chamber 130, and the passages 129 (see FIG. 2), 128, and 127 as long as the passage 134 (see FIG. 1A) in the nozzle body 10 is not blocked by the presence of liquid in the annular passage 96 at the passage 134. When the passage 134 is blocked by the presence of liquid in the annular passage 96, air can no longer be drawn from the tank so that air is withdrawn from the chamber 130. This removal of air from the chamber 130 increases the partial vacuum therein to cause the diaphragm 66 to be moved outwardly to automatically move the poppet valve 85 to its closed position. As a result, the partial vacuum in the chamber 56 (see FIG. 1) is increased in the same manner as described when the opening 59 is blocked so that the main poppet valve 19 is closed.

The poppet valve 85 also is moved to its closed position when the pressure in the tank exceeds a predetermined pressure. This is due to the diaphragm 80 being moved against the force of the spring 117 (see FIG. 1A) by the pressure in the tank being filled to permit the poppet valve 85 to move to its closed position in response to the action of the spring 118.

Figure 5:
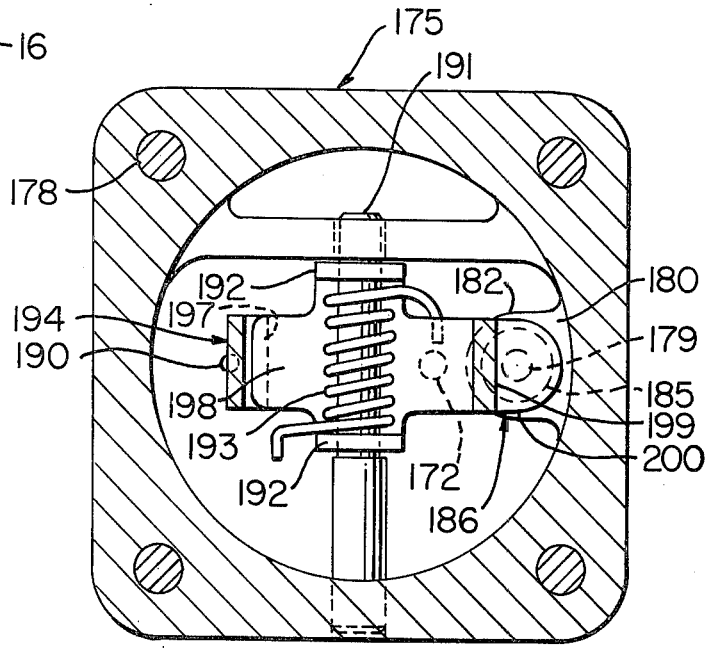
FIG. 5 is a sectional view, partly in plan, of a portion of the nozzle of FIG. 4 taken along line 5—5 of FIG. 4A.
Figure 4A:
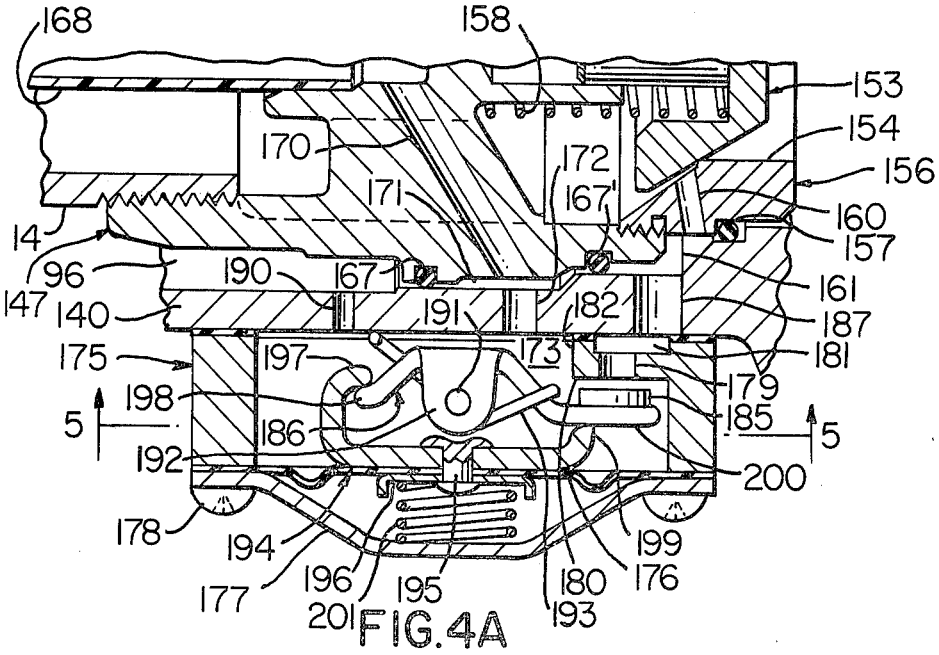
FIG. 4A is an enlarged fragmentary sectional view of a part of FIG. 4.
Figure 4:
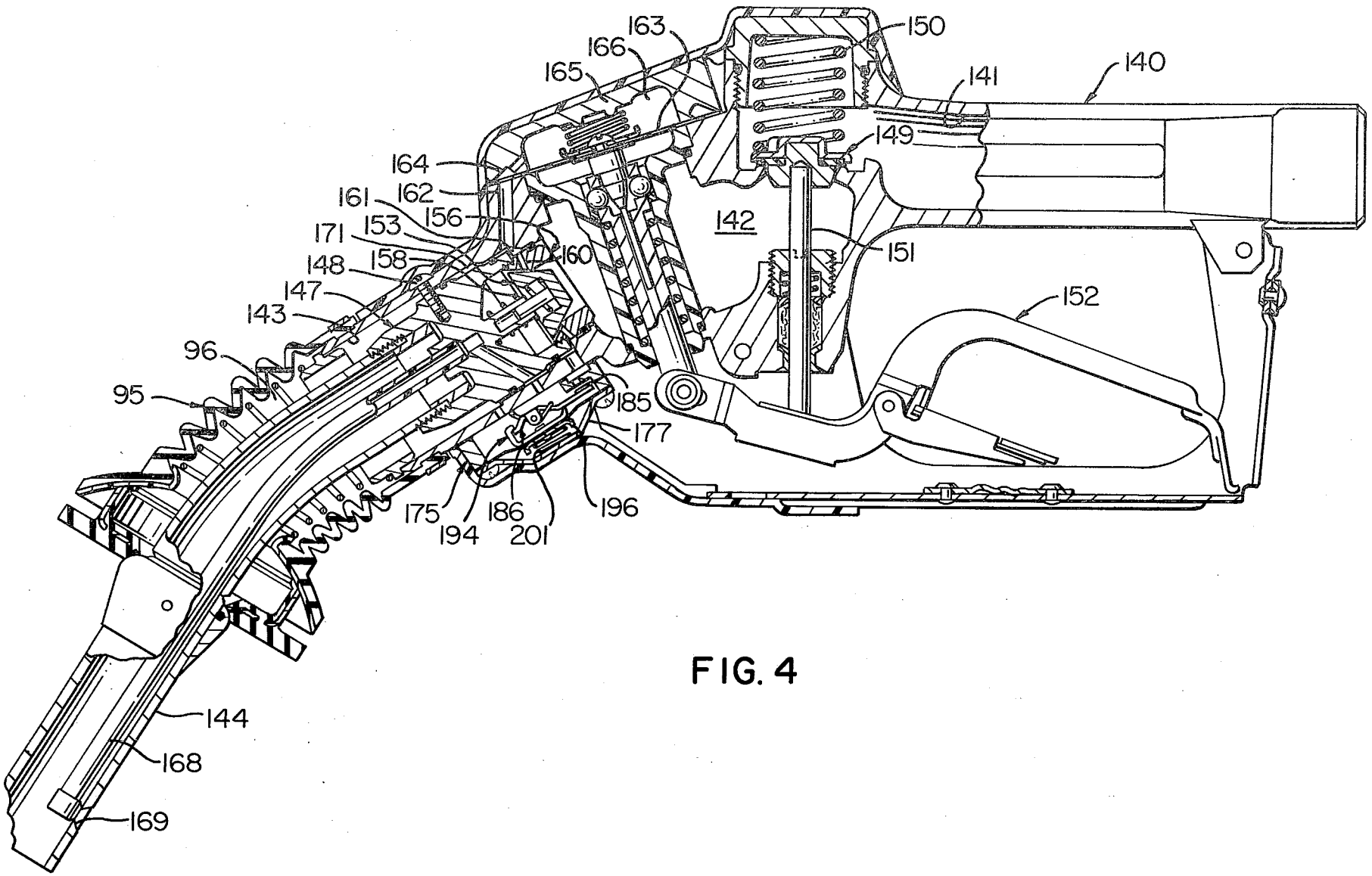
FIG. 4 is a fragmentary sectional view, partly in elevation, of a nozzle having another embodiment of the sensing arrangement of the present invention.

Referring to FIGS. 4, 4A, and 5, there is shown another form of the present invention including a nozzle body 140 having an inlet 141 to which a hose is connected to supply liquid such as gasoline, for example, to a chamber 142 within the interior of the body 140. The body 140 has an outlet 143 with which a spout 144 communicates to receive liquid from the chamber 142.

The spout 144, which is adapted to be inserted within the opening 15 (see FIG. 3) in the fill pipe 16 in the same manner as the spout 14, has an end threaded in a spout adapter 147 (see FIG. 4). The spout adapter 147 is connected to the outlet 143 of the body 140 by a screw 148.

The body 140 has a first or main poppet valve 149 supported therein for control of the flow of liquid from the inlet 141 to the chamber 142 within the interior of the body 140 and from the chamber 142 to the outlet 143 of the body 140. A spring 150 continuously urges the poppet valve 149 to its closed position in which flow from the inlet 141 to the chamber 142 and the outlet 143 is stopped or prevented.

A stem 151 is connected to the poppet valve 149 and has its lower portion extending exteriorly of the body 140. The valve stem 151, which is slidably disposed within the body 140, is moved by a manually operated lever or handle 152. The stem 151 passes through the body 140 in the same manner as the stem 21 passes through the body 20.

A second poppet valve 153, which has a conical shape, is slidably mounted within a passage 154 (see FIG. 4A) in a seat ring 156. The seat ring 156 is secured to the spout adapter 147 by being threadedly connected thereto. A sealing ring 157 is disposed between the body 140 and the seat ring 156 to prevent leakage therebetween.

A spring 158 continuously urges the second poppet valve 153 into engagement with the seat ring 156. Thus, only the pressure of the liquid going from the inlet 141 (see FIG. 4) and past the main poppet valve 149 can overcome the spring 158 and move the second poppet valve 153 to an open position.

As the liquid flows between the poppet valve 153 and the seat ring 156, a venturi effect is created in radially extending passages 160 (two shown in FIG. 4) in the seat ring 156. The outer ends of the passages 160 communicate with an annular chamber 161, which is formed between the body 140, the spout adapter 147, and the seat ring 156. The passages 160 communicate through the annular chamber 161, a passage 162 in the body 140, an opening in a diaphragm 163, and a passage 164 in a cap 165 to a chamber 166, which is formed between the diaphragm 163 and the cap 165.

Sealing rings 167 (see FIG. 4A) and 167' are disposed between the spout adapter 147 and the body 140. These prevent air from entering the chamber 161 from exterior of the body 140.

The chamber 161 also communicates with a vacuum tube 168, which is connected with an opening 169 (see FIG. 4) in the spout 144 adjacent the discharge or free end of the spout 144. The vacuum tube 168 communicates through a passage 170 (see FIG. 4A) in the spout adapter 147 with an annular chamber 171, which is formed between the sealing rings 167 and 167', the spout adapter 147, and the body 140.

The chamber 171 communicates through a passage 172 in the nozzle body 140 to a chamber 173, which is formed within a housing 175 between a diaphragm 176 and the nozzle body 140. A retainer 177 holds the diaphragm 176 on the housing 175. Screws 178 secure the retainer 177 and the housing 175 to the body 140.

The chamber 173 communicates through a passage 179 in a wall 180 of an arcuate depressed portion 182 of the housing 175 to a chamber 181, which is formed within the arcuate depressed portion 182. The passage 179 is closed by a sealing portion 185 on a pivotally mounted carrier 186, which is responsive to movements of the diaphragm 176. The chamber 181 communicates through a passage 187 in the nozzle body 140 with the annular chamber 161.

Accordingly, as long as the passage 179 is open and the opening 169 (see FIG. 4) has not closed due to the liquid within the tank reaching a predetermined level to indicate that the tank is filled, the venturi effect created by the flow of the liquid between the seat ring 156 and the second poppet valve 153 draws air through the tube 168 to create a partial vacuum within the chamber 166. However, as soon as the opening 169 is blocked or the passage 179 (see FIG. 4A) is closed by the sealing portion 185 of the carrier 186, the chamber 166 (see FIG. 4) has its pressure reduced due to the air therein being withdrawn therefrom because of the venturi effect in the passages 160 whereby the diaphragm 163 moves upwardly since the partial vacuum in the chamber 166 is increased. This venturi effect is more particularly described in U.S. Pat. No. 3,085,600 to Briede.

The operation of the main poppet valve 149 by the motion of the diaphragm 163 is in the same manner as described for FIGS. 1 and 2. Thus, upward movement of the diaphragm 163 causes closing of the main poppet valve 149.

The body 140 has the bellows 95 secured thereto in the same manner as described for the body 10. Thus, the annular passage 96 is formed between the bellows 95 and the spout 144 in the same manner as described for FIGS. 1 and 2. The annular passage 96 not only communicates with the vapor recovery equipment but also communicates through a passage 190 (see FIG. 4A) in the nozzle body 140 with the chamber 173.

The carrier 186 is pivotally mounted on a pin 191, which is supported by the housing 175 as shown in FIG. 5. The carrier 186 has depending ears 192 on opposite sides thereof and through which the pin 191 passes. A spring 193 is wrapped around a portion of the pin 191 between the ears 192 as shown in FIG. 5. The spring 193 continuously urges the carrier 186 clockwise (as viewed in FIG. 4A) so that the sealing portion 185 of the carrier 186 does not block the passage 179.

An actuating yoke 194 is fixed to the diaphragm 176 by a rivet 195 and a cup washer 196. Thus, the yoke 194 moves with the diaphragm 176.

The yoke 194 has a finger 197 on one end overlying a portion 198 of the carrier 186. Thus, whenever the diaphragm 176 moves outwardly, the finger 197 engages the portion 198 of the carrier 186 to cause counterclockwise (as viewed in FIG. 4A) pivoting of the carrier 186 about the pin 191 whereby the sealing portion 185 closes the passage 179.

When the diaphragm 176 moves inwardly, a second finger 199 on the yoke 194 engages a portion 200 of the carrier 186 and on which is supported the sealing portion 185. This also causes the sealing portion 185 to close the passage 179. Therefore, inward or outward motion of the diaphragm 176 causes blocking of the passage 179.

When the opening 169 (see FIG. 4) is blocked by the level of the liquid in the tank being filled reaching the predetermined level, the amount of air drawn into the chamber 173 (see FIG. 4A) is significantly reduced because only the passage 190 is providing communication with the tank being filled. The diameter of the passage 190 is substantially smaller than the diameter of the passage 172 so that a significant reduction in the amount of air flow from the tank being filled to the chamber 173 is produced. As a result, the venturi effect produces an increase in the partial vacuum within the chamber 173 so that the force of a spring 201, which is acting between the retainer 177 and the cup washer 196, urges the diaphragm 176 inwardly. The inward movement of the diaphragm 176 causes the second finger 199 of the yoke 194 to engage the portion 200 of the carrier 186 to pivot the carrier 186 counterclockwise about the pin 191 so that the sealing portion 185 on the carrier 186 blocks the passage 179. The blocking of the passage 179 causes the venturi effect to withdraw air from the chamber 166 (see FIG. 4) to increase the partial vacuum in the chamber 166. As a result, the diaphragm 163 moves upwardly to cause automatic closing of the poppet valve 149.

If the pressure in the tank being filled exceeds a predetermined pressure, this increase in pressure is transmitted through each of the passages 172 (see FIG. 4A) and 190 in the nozzle body 140 to the chamber 173. This moves the diaphragm 176 outwardly against the force of the spring 201. The outward motion of the diaphragm 176 causes the finger 197 on the yoke 194 to pivot the carrier 186 counterclockwise about the pin 191 so that the sealing portion 185 closes the passage 179. Again, the pressure in the chamber 166 (see FIG. 4) is reduced to move the poppet valve 149 to its closed position.

If the annular passage 96 has liquid therein, this blocks the passage 190 (see FIG. 4A) to reduce the amount of air drawn into the chamber 173 by the venturi effect. As a result, the partial vacuum in the chamber 173 increases so that the spring 201 moves the diaphragm 176 inwardly. This causes the second finger 199 to engage the portion 200 of the carrier 186 to pivot the carrier 186 counterclockwise about the pin 191 to move the sealing portion 185 to close the passage 179.

Considering the operation of the embodiment of FIGS. 4, 4A, and 5, the diaphragm 176 is normally in the position shown in FIG. 4A because of the force of the spring 201. Flow continues through the nozzle body 140 until either the opening 169 (see FIG. 4) is blocked by the level of the liquid in the tank being filled reaching a predetermined level, the pressure in the tank being filled exceeding a predetermined level, or the annular passage 96 having liquid therein at the passage 190 (see FIG. 4A) in the body 140.

When the opening 169 is blocked, the partial vacuum in the chamber 173 increases so that the diaphragm 176 is moved inwardly by the spring 201 to cause closing of the passage 179. This results in the partial vacuum in the chamber 166 (see FIG. 4) increasing to cause upward motion of the diaphragm 163 whereby the main poppet valve 149 is closed.

If the pressure in the tank exceeds the predetermined level, this is applied through each of the passages 172 (see FIG. 4A) and 190 to the chamber 173 to move the diaphragm 176 outwardly. This also causes the sealing portion 185 to close the passage 179 because of the finger 197 on the yoke 194 engaging the portion 198 of the carrier 186 whereby the venturi effect withdraws air from the chamber 166 (see FIG. 4) to cause upward motion of the diaphragm 163. This results in closing of the main poppet valve 149.

When the annular passage 96 has liquid therein at the passage 190 (see FIG. 4A) in the body 140 to indicate that liquid is flowing from the tank being filled to the vapor recovery equipment, the passage 190 is blocked. This reduces the air flow to the chamber 173 to increase the partial vacuum within the chamber 173 to cause the diaphragm 176 to be moved inwardly by the spring 201. This inward motion of the diaphragm 176 results in the sealing portion 185 closing the passage 179 whereby the venturi effect increases the partial vacuum in the chamber 166 (see FIG. 4). Due to this increase in the partial vacuum in the chamber 166, the diaphragm 163 moves upwardly to cause the main poppet valve 149 to be closed.

Accordingly, the main poppet valve 149 is closed in response to any of three different conditions. These are the tank being filled to a predetermined level, the pressure in the tank exceeding a predetermined pressure, and liquid flowing from the tank through the vapor return means in the nozzle body 140 to the vapor recovery equipment.

Figure 6:
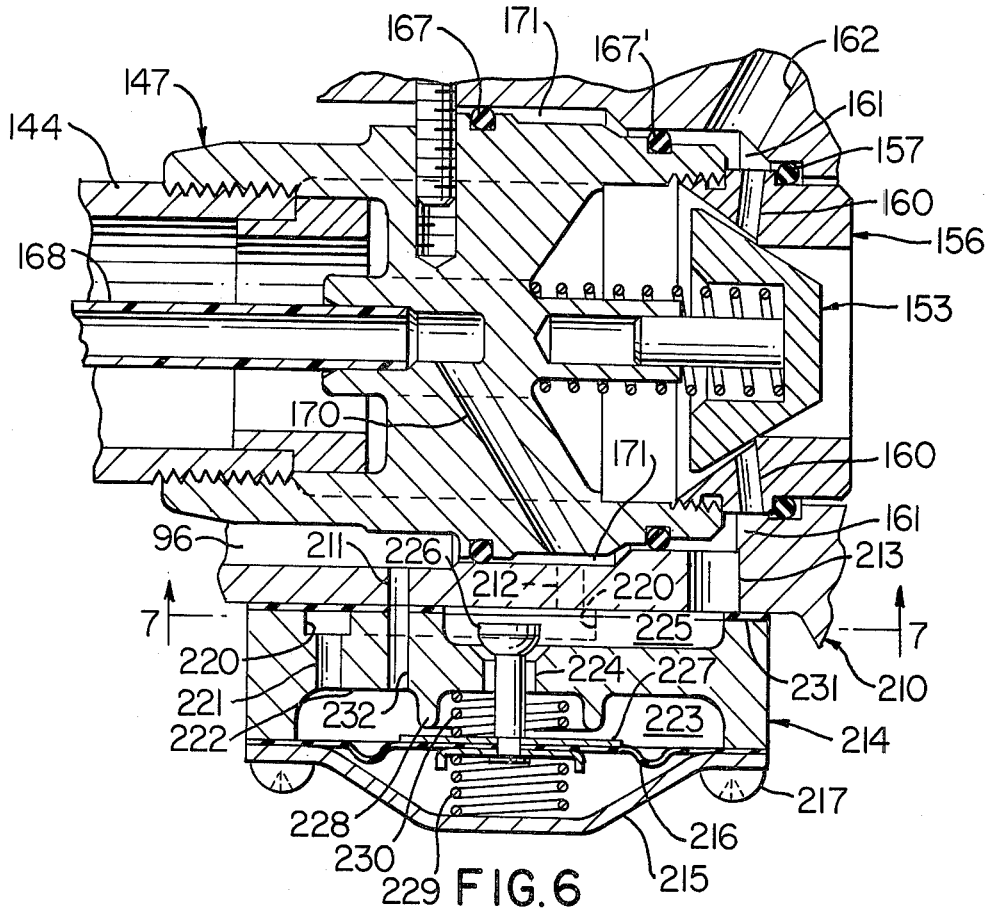
FIG. 6 is a fragmentary sectional view of a portion of a nozzle similar to FIG. 4 but having another of the sensing arrangements of the present invention.
Figure 7:
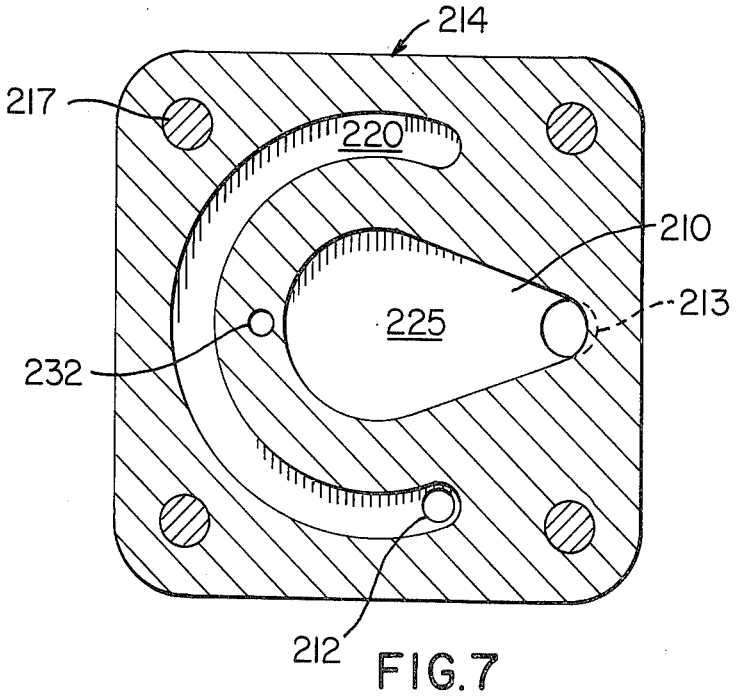
FIG. 7 is a sectional view, partly in plan, of a portion of the sensing arrangement of FIG. 6 taken along line 7—7 of FIG. 6.

Referring to FIGS. 6 and 7, there is shown another form of the sensing arrangement of the present invention and similar to that of FIGS. 4, 4A, and 5. The nozzle body 140 of FIGS. 4, 4A, and 5 is replaced by a nozzle body 210, which is similar to the nozzle body 140 except for the relationship of the location of passages 211, 212, and 213.

The housing 175 of FIGS. 4, 4A, and 5 has been replaced by a housing 214. A retainer 215 holds a diaphragm 216 on the housing 214. The retainer 215 and the housing 214 are secured to the nozzle body 210 by screws 217.

The annular chamber 171 communicates through the passage 212 in the nozzle body 210 with a horseshoe-shaped passage 220 (see FIG. 7) in the housing 214. The horseshoe-shaped passage 220 in the housing 214 communicates through a passage 221 (see FIG. 6) in a divider 222 of the housing 214 with a chamber 223, which is formed between the divider 222 and the diaphragm 216.

The chamber 223 communicates through a passage 224 in the divider 222 of the housing 214 with a chamber 225, which is formed within the housing 214 between the divider 222 and the nozzle body 210. The passage 224 is controlled by a poppet valve 226, which is responsive to movement of the diaphragm 216 through being connected thereto. The chamber 225 communicates through the passage 213 with the annular chamber 161.

In addition to the poppet valve 226 blocking the passage 224, flow from the chamber 223 through the passage 224 to the chamber 225 also can be blocked by a portion 227 of the diaphragm 216 engaging an annular valve seat, which surrounds the passage 224. The annular valve seat is formed by an annular shoulder 228 on the divider 222.

The diaphragm 216 is held in the position of FIG. 6 by springs 229 and 230. The springs 229 and 230 balance each other sufficiently to hold the poppet valve 226 in an open position while also holding the portion 227 of the diaphragm 216 away from the annular shoulder 228.

The passage 211 in the nozzle body 210 provides communication from the annular passage 96 to the chamber 223 through an opening in a seal 231 and a passage 232 in the housing 214. The seal 231 is disposed between the nozzle body 210 and the housing 214.

As long as the poppet valve 226 is in its open position and the portion 227 of the diaphragm 216 does not engage the annular shoulder 228 as shown in FIG. 6, the venturi effect created by the flow of liquid between the seat ring 156 and the second poppet valve 153 draws air through the tube 168 to create a partial vacuum within the chamber 166 as previously mentioned with respect to the embodiment of FIGS. 4, 4A, and 5. However, when the opening 169 is blocked, the pressure in the tank being filled exceeds the predetermined pressure, or the passage 211 is blocked by liquid in the annular passage 96, the flow of air to the annular chamber 161 is reduced to cause the chamber 166 to have its pressure reduced due to air therein being withdrawn therefrom because of the venturi effect in the passages 160. As mentioned with respect to FIGS. 4, 4A, and 5, this causes closing of the main poppet valve 149 to stop flow through the nozzle body 210.

When the opening 169 is blocked by the level of liquid in the tank being filled reaching the predetermined level, the pressure in the chamber 223 is reduced due to the air being withdrawn therefrom rather than through the opening 169. Some air will still be drawn through the annular passage 96, the passage 211 in the nozzle body 210, the opening in the seal 231, and the passage 232 in the housing 214 into the chamber 223. However, this flow of air is sufficiently less than that when the opening 169 is not blocked since the passage 211 is of substantially smaller diameter than the passage 212. Accordingly, the withdrawal of air from the chamber 223 by the venturi effect enables the spring 229 to move the portion 227 of the diaphragm 216 into engagement with the end of the annular shoulder 228 to stop flow through the passage 224. As a result, the venturi effect can withdraw air only from the chamber 166 to cause automatic closing of the main poppet valve 149.

When the passage 211 is blocked by the presence of liquid in the annular passage 96 at the location of the passage 211, the flow of air into the chamber 223 is reduced since air can only flow through the opening 169. As a result of this decreased amount of air flowing into the chamber 223, the pressure therein is reduced. The force of the spring 229 moves the portion 227 of the diaphragm 216 into engagement with the annular shoulder 228 to prevent additional flow or air into the annular chamber 161. As a result, the venturi effect withdraws air from the chamber 166 to cause automatic closing of the main poppet valve 149.

Whenever the pressure in the tank increases beyond a predetermined pressure, this pressure is applied through both of the passages 211 and 212 in the nozzle body 210 to the chamber 223. This causes the diaphragm 216 to move outwardly against the force of the spring 229 to move the poppet valve 226 to its closed position to block the passage 224. When this occurs, there is no further air flow through the passage 224 to the annular chamber 161. As a result, air is withdrawn from the chamber 166 by the venturi effect to cause automatic closing of the main poppet valve 149.

Thus, in this embodiment of FIGS. 6 and 7, the diaphragm 216 is moved inwardly by the force of the spring 229 whenever there is blocking of the opening 169 because of the liquid in the tank reaching the predetermined level or there is liquid in the annular passage 96 to block the passage 211. This inward movement of the diaphragm 216 causes the portion 227 to engage the annular shoulder 228 and stop flow of air to the venturi.

An increase in pressure in the tank being filled above the predetermined pressure causes outward motion of the diaphragm 216 against the force of the spring 229. When this occurs, the poppet valve 226 blocks the passage 224 to prevent the supply of any further air to the venturi.

Figure 8:
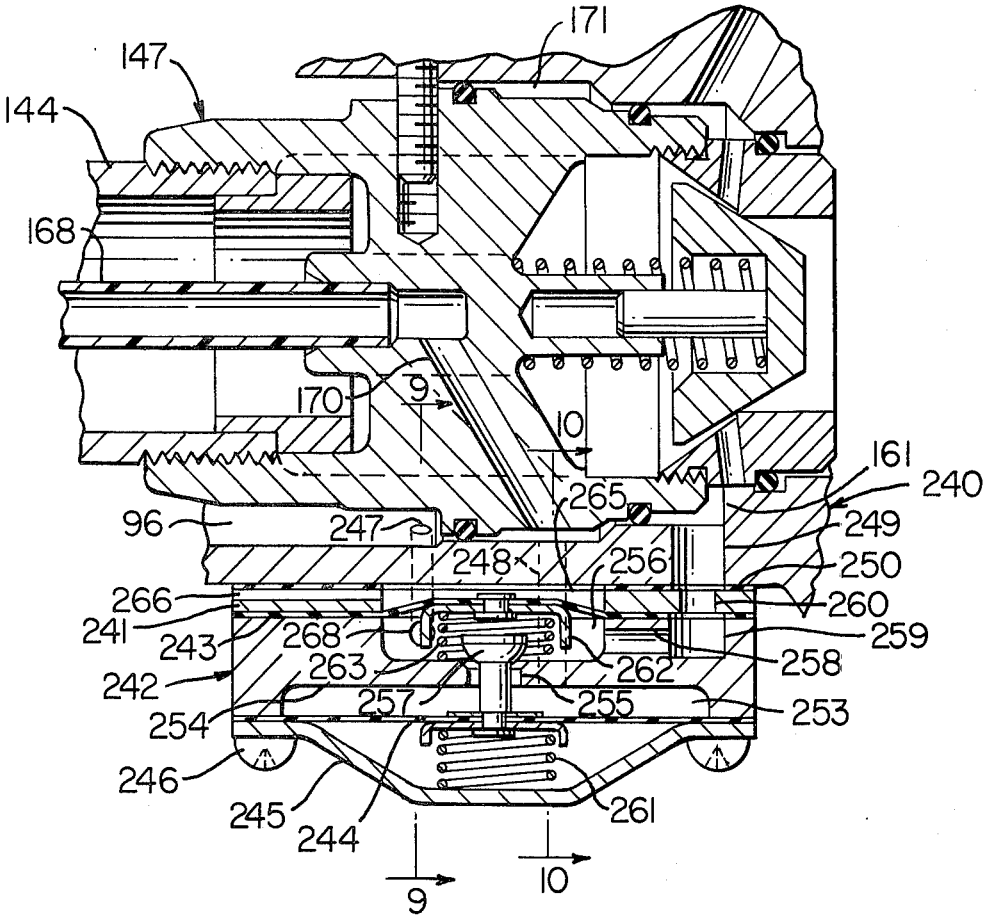
FIG. 8 is a fragmentary sectional view of a portion of a nozzle similar to FIG. 4 having still another form of the sensing arrangement of the present invention.
Figure 9:
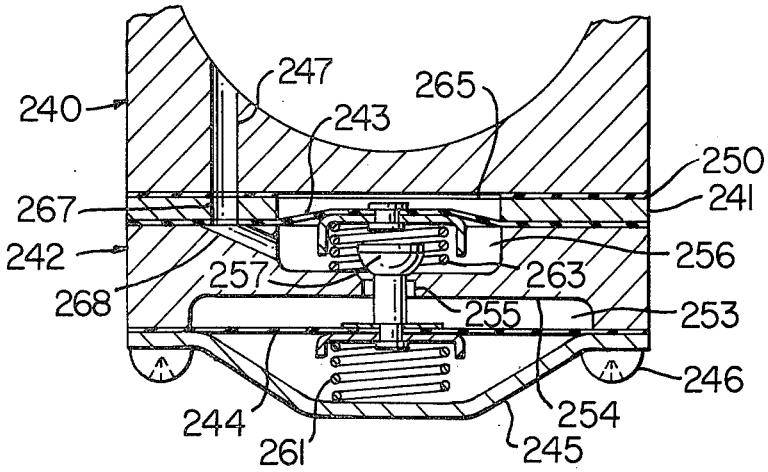
FIG. 9 is a fragmentary sectional view taken along line 9—9 of FIG. 8 but with the spout adapter removed and showing the relationship of various portions of the sensing arrangement of FIG. 8.
Figure 10:
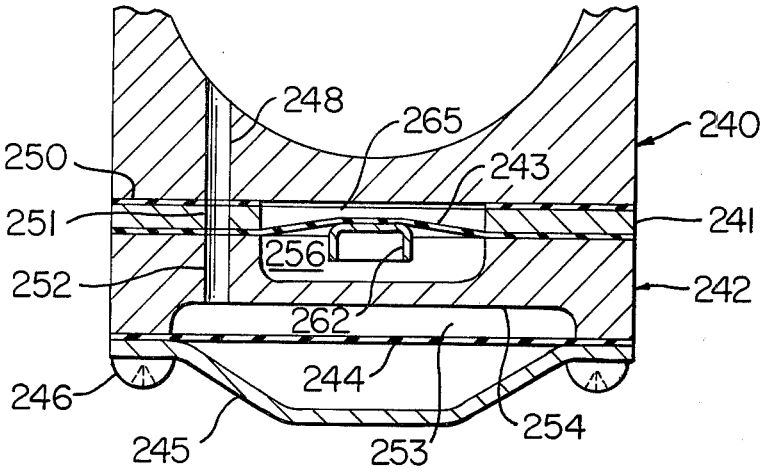
FIG. 10 is a fragmentary sectional view taken along line 10—10 of FIG. 8 but with the spout adapter removed and showing the relationship of various portions of the sensing arrangement.

Referring to FIGS. 8–10, there is shown another form of the sensing arrangement of the present invention in which the nozzle body 140 of FIG. 5 is replaced by a nozzle body 240 in the same manner as the nozzle body 210 replaced the nozzle body 140 in FIGS. 6 and 7. Similarly, the housing 175 of FIGS. 4, 4A, and 5 is replaced by a body 241 and a housing 242. A diaphragm 243 is disposed between the body 241 and the housing 242. A diaphragm 244 is held on the housing 242 by a retainer 245. Screws 246 secure the body 241, the housing 242, and the retainer 245 to the nozzle body 240.

The nozzle body 240 has a passage 247 communicating with the annular passage 96, a passage 248 communicating with the annular chamber 171, and a passage 249 communicating with the annular chamber 161. Thus, the same three areas are communicated with by the three passages 247–249 in the nozzle body 240 as in the nozzle body 140 of FIGS. 4, 4A, and 5 and the nozzle body 210 in FIGS. 6 and 7.

The passage 248 (see FIG. 10) communicates through an opening in a seal 250, which is disposed between the nozzle body 240 and the body 241, a passage 251 in the body 241, an opening in the diaphragm 243, and a passage 252 in the housing 242 to a chamber 253, which is formed between the diaphragm 244 and a divider 254 of the housing 242. The divider 254 has a passage 255 (see FIGS. 8 and 9) extending therethrough to provide communication from the chamber 253 to a chamber 256, which is formed between the divider 254 and the diaphragm 243. The flow through the passage 255 is controlled by a poppet valve 257, which is secured to the diaphragm 244 so as to be responsive thereto.

The chamber 256 communicates through a passage 258 (see FIG. 8) in the housing 242 to a chamber 259, which is formed within the housing 242. The chamber 259 communicates through an opening in the diaphragm 243, a passage 260 in the body 241, an opening in the seal 250, and the passage 249 in the nozzle body 240 to the annular chamber 161. Thus, there is communication for air to flow from the tank being filled through the opening 169 in the spout 144 and the vacuum tube 168 to the annular chamber 161. This enables the venturi effect to draw air from the tank being filled.

A spring 261 acts on the diaphragm 244 to urge it inwardly so that the poppet valve 257 does not block the passage 255 unless the diaphragm 244 is moved outwardly by pressure within the tank being filled. This occurs only when the pressure exceeds the predetermined pressure.

The diaphragm 243 has a cup-shaped element 262 secured thereto for movement therewith so that the cup-shaped element 262 is responsive to movements of the diaphragm 243. A spring 263 acts on the element 262 to urge the diaphragm 243 to the position of FIG. 8. In this position, the annular end of the element 262 is spaced from the divider 254 of the housing 242 to allow air to flow from the chamber 253 through the passage 255 to the chamber 256.

A chamber 265 is disposed on the opposite side of the diaphragm 243 from the chamber 256. The chamber 265 is formed by the diaphragm 243, the body 241, and the nozzle body 240. The chamber 265 communicates with the atmosphere through a passage 266 (see FIG. 8) in the body 241.

As shown in FIG. 9, the chamber 256 also communicates with the passage 247 in the nozzle body 240 through an opening in the seal 250, a passage 267 in the body 241, an opening in the diaphragm 243, and a passage 268 in the housing 242. Accordingly, the chamber 256 is not only in communication with the chamber 253 but also with the annular passage 96 through the passage 247.

Whenever the opening 169 in the spout 144 is blocked, air flow to the chamber 253 from the vacuum tube 168 is stopped so that the pressure of air in the chamber 256, which is in communication with the chamber 253 through the passage 255, is reduced. This results in the atmospheric pressure in the chamber 265 moving the annular end of the cup-shaped element 262 into engagement with the divider 254 of the housing 242. This blocks the passage 255 to stop the flow of air from the tank being filled to the annular chamber 161 so that the venturi effect withdraws air from the chamber 166 to reduce its pressure whereby the main poppet valve 149 is closed due to the diaphragm 163 moving upwardly.

Whenever the pressure in the tank exceeds the predetermined pressure, this increase in pressure acts on the diaphragm 244 to move it outwardly against the force of the spring 261. This causes the poppet valve 257 to block the passage 255 so that air can no longer be withdrawn from the tank being filled through the vacuum tube 168. Because the passage 247 is smaller in diameter than the passage 248, the amount of air still flowing to the annular chamber 161 from the tank by the annular passage 96 and the passages 247, 267, and 268 does not provide sufficient air for the venturi effect to prevent the additional withdrawal of air from the chamber 166. As a result, the reduction of pressure in the chamber 166 causes the diaphragm 163 to move upwardly whereby the main poppet valve 149 is automatically closed.

Whenever the annular passage 96 has liquid therein at the location of the passage 247, the passage 247 is blocked so that the presence of the liquid at this location in the annular passage 96 is sensed. This blocking of the passage 247 causes a reduction in the pressure within the chamber 256 because of a smaller quantity of air flowing thereto so that the diaphragm 243 is moved outwardly by the atmospheric pressure within the chamber 265. This causes the annular end of the cup-shaped element 262 to engage the divider 254 of the housing 242 so that air can no longer be withdrawn from the tank being filled through the chamber 253 to the annular chamber 161. As a result, the venturi effect withdraws additional air from the chamber 166 so that the diaphragm 163 moves upwardly to produce automatic closing of the main poppet valve 149.

Thus, in this embodiment, the increase in pressure in the tank beyond the predetermined pressure causes the poppet valve 257 to be moved to its closed position to block the passage 255. The level of the liquid in the tank reaching the predetermined level causes a reduction of the pressure in the chambers 253 and 256 so that the cup-shaped element 262 blocks the passage 255. Likewise, the presence of liquid in the annular passage 96 at the location of the passage 247 in the nozzle body 240 causes the cup-shaped element 262 to engage the divider 254 of the housing 242 to block the passage 255.

Figure 11:
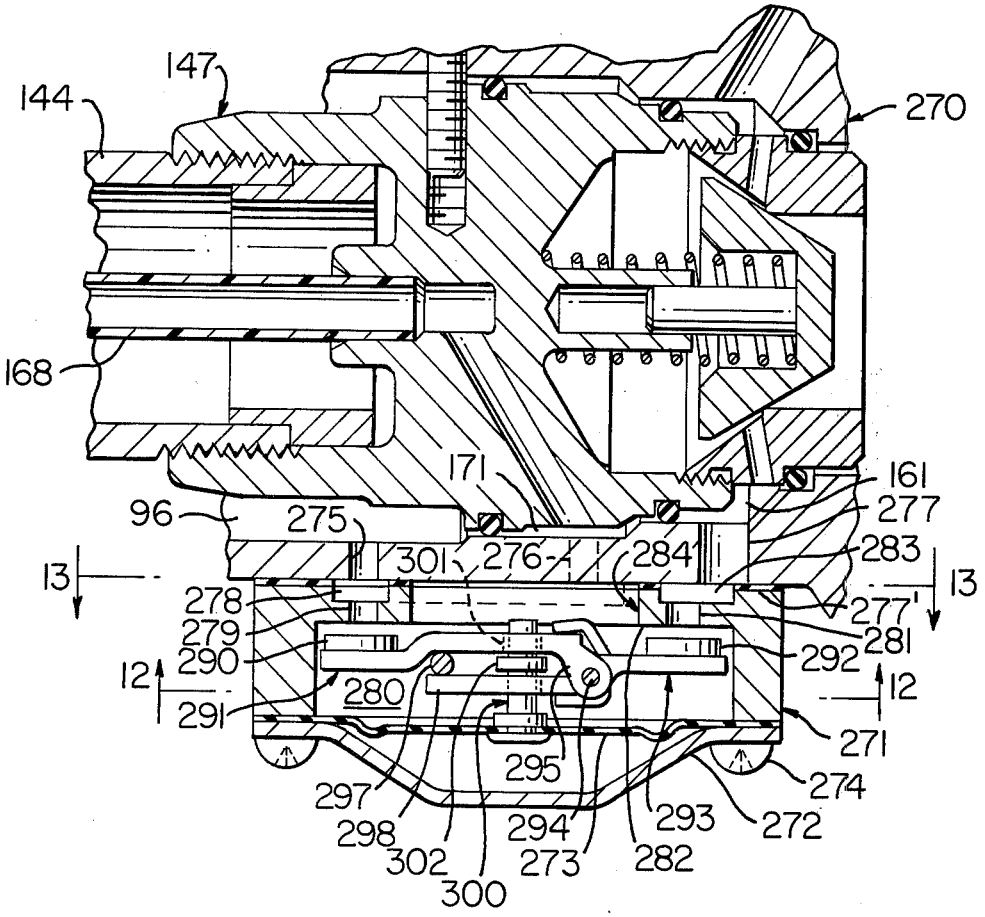
FIG. 11 is a fragmentary sectional view of a portion of a nozzle similar to FIG. 4 having a further modification of the sensing arrangement of the present invention.
Figure 12:
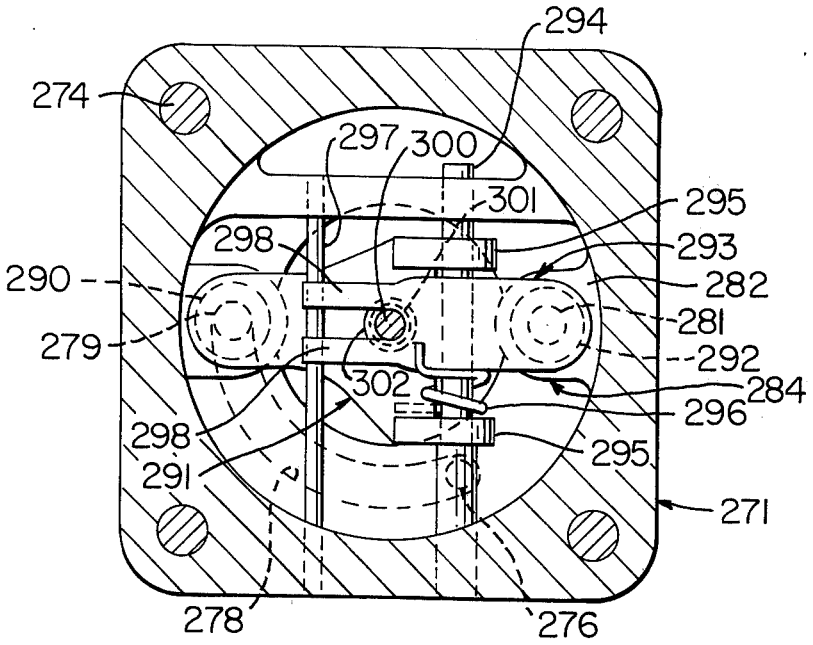
FIG. 12 is a fragmentary sectional view, partly in plan, of a portion of the sensing arrangement of FIG. 11 and taken along line 12—12 of FIG. 11.
Figure 13:
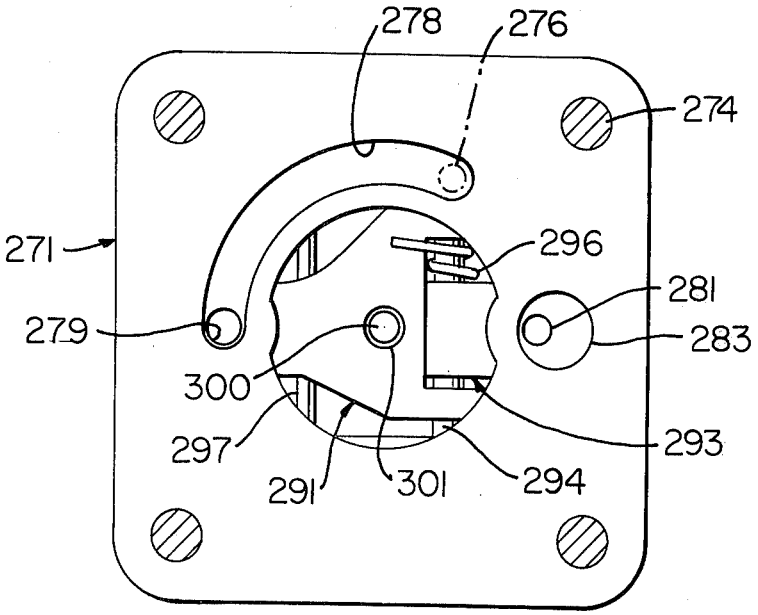
FIG. 13 is a fragmentary plan view, partly in section, of a portion of the sensing arrangement of FIG. 11 taken along line 13—13 of FIG. 11.

Referring to FIGS. 11–13, there is shown another sensing arrangement for detecting the presence of liquid in the annular passage 96 while still obtaining automatic shut off when the level of the liquid in the tank being filled reaches the predetermined level or the pressure in the tank being filled exceeds the predetermined pressure. This embodiment uses the nozzle structure of FIGS. 4, 4A, and 5 except that the nozzle body 210 is replaced by a nozzle body 270 and the housing 214 is replaced by a housing 271. A retainer 272 holds a diaphragm 273 on the end of the housing 271. Screws 274 secure the retainer 272 on the housing 271 to the nozzle body 270.

The nozzle body 270 has a passage 275 communicating with the annular passage 96, a passage 276 communicating with the annular chamber 171, and a passage 277 communicating with the annular chamber 161.

The passage 276 provides communication from the annular chamber 171 through an opening in a seal 277', which is disposed between the body 270 and the housing 271, to a horseshoe-shaped passage 278 (see FIG. 13) in the housing 271. The other end of the horseshoe-shaped passage 278 communicates through a passage 279 in the housing 271 with a chamber 280, which is formed within the housing 271 between the diaphragm 273 and the nozzle body 270.

The chamber 280 communicates through a passage 281 in a wall 282 of an arcuate depressed portion 284 of the housing 271 to a chamber 283, which is formed within the depressed portion 284 of the housing 271. The chamber 283 communicates through an opening in the seal 277' and the passage 277 in the nozzle body 270 to the annular chamber 161.

The passage 275 provides communication from the annular passage 96 to the chamber 280 through an opening in the seal 277', the horseshoe-shaped passage 278 in the housing 271, and the passage 279. The communication of the passage 275 with the horseshoe-shaped passage 278 is at the same end as the passage 279 since the axes of the passages 275 and 279 are aligned with each other.

Accordingly, the venturi effect withdraws air from the tank being filled through both of the passages 275 and 276 to the chamber 280. Thus, as long as the passages 279 and 281 are open, air can flow from the tank being filled to the venturi.

Flow through the passage 279 is blocked when a seal 290 on one end of a pivotally mounted carrier 291 closes the passage 279. The passage 281 is blocked by a seal 292 on a pivotally mounted carrier 293 engaging the wall 282.

The carriers 291 and 293 are pivotally mounted on a pin 294, which is supported by the housing 271. The pin 294 extends through ears 295 (see FIG. 12) on opposite sides of the carrier 291 and through a main body portion of the carrier 293.

A spring 296, which is carried by the pin 294, acts on a surface of the carrier 291 to urge it outwardly (counterclockwise in FIG. 11 about the pin 294) against a stop pin 297, which also is carried by the housing 271 and is parallel to the pivot pin 294. This position of the carrier 291 holds the seal 290 away from the passage 279 as shown in FIG. 11.

The spring 296 also acts on a portion of the carrier 293 to urge a pair of fingers 298 inwardly (clockwise in FIG. 11 about the pin 294) against the stop pin 297. This position of the carrier 293 holds the seal 292 away from the passage 281 as shown in FIG. 11.

A pin 300, which is fixed to the diaphragm 273 so as to be responsive to its movements, extends between the fingers 298 of the carrier 293 (see FIG. 12) and through an opening 301 in the carrier 291. The pin 300 has a shoulder 302 between the fingers 298 of the carrier 293 and the carrier 291 as shown in FIG. 11.

Accordingly, outward motion of the diaphragm 273 causes the shoulder 302 to engage the fingers 298 to pivot the carrier 293 counterclockwise (as viewed in FIG. 11) about the pin 294 so that the seal 292 closes the passage 281. Inward movement of the diaphragm 273 causes the shoulder 302 to engage the carrier 291 to cause clockwise (as viewed in FIG. 11) pivoting of the carrier 291 about the pin 294 whereby the seal 290 closes the passage 279.

Whenever the pressure in the tank being filled exceeds the predetermined pressure, the diaphragm 273 is moved outwardly because of the increase in pressure in the chamber 280. This is due to the pressure in the tank being transmitted through each of the passages 275 and 276 in the nozzle body 270 to the chamber 280.

When this occurs, the seal 292 blocks the passage 281 to prevent the venturi from withdrawing air from the chamber 280. As a result, the pressure in the chamber 166 is reduced because of the venturi effect withdrawing air therefrom whereby the diaphragm 163 is moved upwardly to cause the main poppet valve 149 to close.

When the opening 169 in the spout 144 is blocked by the level of the liquid in the tank reaching the predetermined level, the pressure in the chamber 280 is reduced because of the venturi effect withdrawing air therefrom. As a result, the diaphragm 273 moves inwardly so that the seal 290 blocks the passage 279. Again, this causes the venturi to be unable to withdraw any air from the tank being filled so that the pressure in the chamber 166 is reduced to enable the diaphragm 163 to move upwardly to cause the main poppet valve 149 to close.

When the liquid in the annular passage 96 reaches the location of the passage 275 in the nozzle body 270, its presence is sensed through the passage 275 being blocked by the liquid. As a result, the vacuum in the chamber 280 increases sufficiently to enable the diaphragm 273 to move inwardly sufficiently to cause the carrier 291 to be pivoted clockwise so that the seal 290 blocks the passage 279. This prevents any flow of air to the venturi from the tank being filled whereby air is withdrawn from the chamber 166. This results in the diaphragm 163 moving upwardly to cause the main poppet valve 149 to be closed.

An advantage of this invention is that a single mechanism can be utilized to automatically stop flow in response to any of the presence of liquid in the vapor return means, the tank level reaching a predetermined level, and the pressure in the tank exceeding a predetermined pressure. Another advantage of this invention is that a customer is not charged for gasoline which is not retained in the vehicle tank but is returned to the supply tank through the vapor recovery arrangement. A further advantage of this invention is that gasoline cannot flow from the vehicle tank being filled to the supply tank through the vapor recovery arrangement.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An automatic shut-off nozzle comprising a body having an inlet and an outlet, a valve in said body controlling flow of liquid from said inlet to said outlet, means controlling the operation of said valve, spout means communicating with said outlet and having its free end for disposition in an opening of a fill pipe of a vehicle tank or the like, means to return vapor from the tank being filled, sealing means to form a seal between the fill pipe opening and said vapor return means when said spout means is disposed in the fill pipe, and means to sense the presence of liquid in said vapor return means to cause said controlling means to be activated to move said valve to its closed position.

2. The nozzle according to claim 1 in which said controlling means includes manual operated means controlling the operation of said valve and release means to release said manual operated means to allow closing of said valve and stoppage of liquid flow, a chamber, and flexible means forming a wall of said chamber and having said release means connected thereto; communicating means communicates said chamber with the tank being filled; means creates a partial vacuum in said chamber when liquid is flowing through said body; and said sensing means includes means to cause blocking of said communicating means when the presence of liquid is sensed in said vapor return means, the blocking of said communicating means increasing the partial vacuum in said chamber when said valve is open to move said release means to release said manual operated means to close said valve.

3. The nozzle according to claim 2 in which said sensing means includes passage means communicating with said vapor return means to receive liquid when liquid is present at a predetermined location in said vapor return means and said causing means of said sensing means includes flexible means responsive to said passage means being blocked by liquid received by said passage means to cause blocking of said communicating means.

4. The nozzle according to claim 3 in which said flexible means of said causing means of said sensing means includes a diaphragm movable in response to said passage means being blocked by liquid received by said passage means and means responsive to movement of said diaphragm to block said communicating means.

5. The nozzle according to claim 1 in which said controlling means includes manual operated means controlling the operation of said valve and release means to release said manual operated means to allow closing of said valve and stoppage of liquid flow, a first chamber, and first flexible means forming a wall of said chamber and having said release means connected thereto; communicating means communicates said first chamber with the tank being filled; first partial vacuum means creates a partial vacuum in said first chamber when liquid is flowing through said body; said sensing means includes passage means communicating with said vapor return means to receive liquid when liquid is present at a predetermined location in said vapor return means; a second chamber communicates with said passage means; second partial vacuum means creates a partial vacuum in said second chamber when liquid is flowing through said body; second flexible means forms a wall of said second chamber and is movable by an increase in the partial vacuum in said second chamber by said second partial vacuum means when said passage means is blocked by liquid; and means responsive to movement of said second flexible means blocks said communicating means so that said first partial vacuum means increases the partial vacuum in said first chamber when said valve is open to move said release means to release said manual operated means to close said valve.

6. The nozzle according to claim 5 in which said communicating means includes a passage and said blocking means includes means connected to said second flexible means for movement therewith to close said passage of said communicating means when liquid blocks said passage means.

7. The nozzle according to claim 6 in which said connected means of said blocking means has third flexible means connected thereto and said third flexible means is responsive to the pressure in the tank being filled exceeding a predetermined pressure to move said connected means to close said passage.

8. The nozzle according to claim 1 in which said controlling means includes manual operated means controlling the operation of said valve and release means to release said manual operated means to allow closing of said valve and stoppage of liquid flow, a first chamber, and first flexible means forming a wall of said first chamber and having said release means connected thereto; communicating means communicates said first chamber with the tank being filled; means creates a partial vacuum in said first chamber when liquid is flowing through said body; said communicating means includes a second chamber intermediate said partial vacuum means and the tank being filled and communicating with each; said sensing means includes passage means communicating said vapor return means and said second chamber; second flexible means forms a wall of said second chamber and is movable in a first direction by an increase in the partial vacuum of said second chamber when said passage means is blocked by liquid; and means responsive to movement of said second flexible means blocks said communicating means so that said partial vacuum means increases the partial vacuum in said first chamber when said valve is open to move said release means to release said manual operated means to close said valve.

9. The nozzle according to claim 8 in which said second flexible means moves in a second direction, opposite to the first direction, when the pressure in the tank being filled exceeds a predetermined pressure and said responsive means includes means to block said communicating means in response to movement of said second flexible means in the second direction so that said partial vacuum means increases the partial vacuum in said first chamber when said valve is open to move said release means to release said manual operated means to close said valve.

10. The nozzle according to claim 9 in which said communicating means includes passage means connecting said second chamber with said partial vacuum means; and said responsive means includes first blocking means connected to said second flexible means to block said connecting passage means when said second flexible means moves in the first direction and second blocking means connected to said second flexible means to block said connecting passage means when said second flexible means moves in the second direction.

11. The nozzle according to claim 9 in which said communicating means includes passage means connecting said second chamber with said partial vacuum means and said responsive means includes pivotally mounted means to block said connecting passage means when said second flexible means moves in the first or second direction and means connected to said second flexible means to act on said pivotally mounted means when said second flexible means moves in the first or second direction.

12. The nozzle according to claim 9 in which said communicating means includes first passage means connecting said second chamber with said passage means of said sensing means and with the end of said communicating means communicating with the tank being filled and second passage means connecting said second chamber with said partial vacuum means, and said responsive means includes first pivotally mounted means to block said first passage means when said second flexible means moves in the first direction and second pivotally mounted means to block said second passage means when said second flexible means moves in the second direction.

13. The nozzle according to claim 12 including single actuating means for said first pivotally mounted means and said second pivotally mounted means, said single actuating means being movable in response to movement of said second flexible means.

14. The nozzle according to claim 8 in which said communicating means includes a third chamber intermediate said second chamber and the tank being filled; third flexible means forming a wall of said second chamber of said communicating means; passage means connecting said second chamber and said third chamber; said responsive means responsive to movement of said second flexible means includes means connected to said second flexible means to block said connecting passage means when said second flexible means moves in the first direction, said second flexible means also moving in the first direction when said communicating means is blocked at its end communicating with the tank being filled by the level of the liquid in the tank reaching a predetermined level; and means connected to said third flexible means blocks said connecting passage means when said third flexible means moves in the first direction when the pressure in the tank being filled exceeds a predetermined pressure.

* * * * *